US008307793B2

(12) United States Patent
Paolo et al.

(10) Patent No.: US 8,307,793 B2
(45) Date of Patent: Nov. 13, 2012

(54) INTERNAL COMBUSTION ENGINE WITH TWO INTAKE VALVES PER CYLINDER WHICH ARE ACTUATED HYDRAULICALLY AND HAVE DIFFERENTIATED RETURN SPRINGS

(75) Inventors: Ferreri Paolo, Orbassano (IT); Gianolio Laura, Orbassano (IT); Micelli Damiano, Orbassano (IT); Peci Davide, Orbassano (IT); Perna Francesco, Orbassano (IT); Vattaneo Francesco, Orbassano (IT)

(73) Assignee: C.R.F. Società Consortile per Azioni, Orbassano (Torino) (IT)

( * ) Notice: Subject to any disclaimer, the term of this patent is extended or adjusted under 35 U.S.C. 154(b) by 379 days.

(21) Appl. No.: 12/711,729

(22) Filed: Feb. 24, 2010

(65) Prior Publication Data

US 2010/0294220 A1 Nov. 25, 2010

(30) Foreign Application Priority Data

May 25, 2009 (EP) ..... 09425206

(51) Int. Cl.
*F01L 9/02* (2006.01)

(52) U.S. Cl. ..... 123/90.12; 123/90.13; 123/90.33; 123/90.35

(58) Field of Classification Search ..... 123/90.12, 123/90.13, 90.33, 90.35
See application file for complete search history.

(56) References Cited

U.S. PATENT DOCUMENTS

| | | | | |
|---|---|---|---|---|
| 4,887,562 | A | 12/1989 | Wakeman | |
| 6,918,364 | B2 * | 7/2005 | Vattaneo et al. | 123/90.55 |
| 7,140,336 | B2 * | 11/2006 | Vattaneo et al. | 123/90.55 |
| 7,219,636 | B2 * | 5/2007 | Sawada | 123/90.17 |

FOREIGN PATENT DOCUMENTS

| | | |
|---|---|---|
| DE | 36 11 476 | 10/1987 |
| DE | 42 11 632 | 10/1993 |
| EP | 0 803 642 | 10/1997 |
| EP | 1 273 770 | 1/2003 |
| EP | 1 344 900 | 9/2003 |
| EP | 1 555 398 | 7/2005 |
| EP | 1 674 673 | 6/2006 |
| WO | 98/34014 | 8/1998 |

OTHER PUBLICATIONS

European Search Report EP 09425206.1 dated Oct. 21, 2009.

* cited by examiner

*Primary Examiner* — Ching Chang
(74) *Attorney, Agent, or Firm* — Nixon & Vanderhye P.C.

(57) ABSTRACT

An internal combustion engine comprises at least two intake valves per cylinder, each of them provided with respective spring return means which push the valve towards a closed position. The intake valves of each cylinder are controlled by a single cam of an engine camshaft, through a single tappet actuated by said cam and through a hydraulic system. The hydraulic system comprises a master cylinder having a piston positively connected to said tappet and two hydraulic actuators respectively associated to the two intake valves and which are both hydraulically connected to a common pressure chamber of said master cylinder. The return spring means associated to the intake valves of one and the same engine cylinder have predetermined loadS and/or rigidities which are different from each other, in such a way that said intake valves have different lift profiles, so as to cause a swirl motion of the air fed into the engine cylinder, which allows to improve the air-fuel mixing.

13 Claims, 14 Drawing Sheets

INTERNAL COMBUSTION ENGINE WITH TWO INTAKE VALVES PER CYLINDER WHICH ARE ACTUATED HYDRAULICALLY AND HAVE DIFFERENTIATED RETURN SPRINGS

This application claims priority to European Application No. 09425206.1, filed 25 May 2009, the entire contents of which is hereby incorporated by reference.

FIELD OF THE INVENTION

The present invention concerns internal combustion engines of the kind comprising at least two intake valves per engine cylinder, each of which is provided with respective return spring means, which push the valve towards a closed position, and wherein said at least two intake valves are controlled by a single cam of an engine camshaft, via a single tappet which is actuated by said cam, and a hydraulic system including a master cylinder having a pumping piston operatively connected to said tappet, and two hydraulic actuators respectively associated to the two intake valves, and hydraulically connected to a common pressure chamber of said master cylinder.

PRIOR ART

Internal combustion engines of the above-mentioned kind are described for example in DE3611476A1 and in EP1674673A1. FIG. 2 in DE3611476A1 shows an engine where the two intake valves of each cylinder are actuated by a hydraulic system which is isolated from the outside, which actuates the two intake valves according to a lift profile which is permanently linked to the actuating cam profile. On the contrary, the engine shown in EP1674673A1 is of the kind provided with variable intake valve actuation means, wherein a solenoid valve associated with each engine cylinder controls the communication of the said intake valve hydraulic actuating system with a low-pressure exhaust channel, so that, when said solenoid valve is open, the intake valves of a given cylinder are uncoupled from their actuating cam and are kept closed by said return spring means, the system including in addition electronic control means to control the solenoid valve which is associated to each cylinder, in such a way as to vary the time in the opened condition and/or the lift of the respective intake valves as a function of the engine operating conditions.

The present invention is applicable both to engines of the above-mentioned kind, shown in DE3611476A1, with a "fixed" valve actuation, and to engines of the kind shown in EP1674673A1, with a variable valve actuation.

General Technical Problem

In current internal combustion engines, it is attempted to favour a circulating motion of the charge (air or air/fuel) fed into the cylinder, with the aim of improving the air/fuel mixing and making combustion faster and steadier, with a lower cyclic variation of the combustion pressure, so as to achieve an overall improvement of consumptions and emissions. A particularly significant feature is the charge motion around the cylinder axis, the so-called "swirl", both for compression ignition engines and for spark ignition engines. In order to achieve the above-mentioned swirl, various solutions have been proposed, among which an asymmetrical configuration of the two intake pipes associated with the cylinder, the presence of throttles (with fixed or variable width) in one of the two intake pipes of the cylinder, the arrangement of shields, within the combustion chamber, for one of the two intake valves, or even the accomplishment of differentiated intake valve lifts (for engines provided with two intake valves per cylinder). All the above-mentioned solutions, which have so far been used to create swirl, and the associated devices (snail pipes, throttle valves, gate valves, fixed baffles in the intake pipes, valve shields, differentiated cam profiles) normally cause a decay of the displacement efficiency, due to the smaller actual area of the air flow and to fluid mechanical losses. Moreover, such systems have a remarkable impact on the engine design and on the related costs.

Object of the Invention

The object of the present invention is to provide an internal combustion engine of the kind mentioned at the beginning of the present description, that ensures a high swirl motion with extremely simple and inexpensive means, and without causing the above mentioned disadvantages, which are typical in the known solutions.

SUMMARY OF THE INVENTION

In view of achieving this object, the present invention provides an engine having all the features described at the beginning of the present description, and further characterized in that the return spring means associated to the intake valves of a single engine cylinder have predetermined loads and/or flexibilities which are different from each other, so that said intake valves of each cylinder have lift profiles which are different from each other.

Thanks to this feature, the swirl motion of the charge introduced into the combustion chamber, caused during the intake stage by the lift difference between the two intake valves, during the subsequent compression stage converts into a higher turbulence and a higher uniformity of the air/fuel mixture, as compared to the basic case with symmetrical lifts.

In a preferred embodiment, wherein the return spring means include at least one coil spring associated to each intake valve, there are provided identical springs for the two intake valves of each cylinder, but one or two shims are interposed between one end of the spring which is associated to one of the two valves and the related support surface, in such a way that the springs of the two valves are subjected to different loads. In this case, the difference between the lifts of the two intake valves of the cylinder is proportional to the difference of the loads of the related return springs.

In any case, the average lift of the two intake valves of each cylinder remains the same as the one resulting if the two valves were not differentiated in load and/or flexibility, because the displacements of the two valves are in any case mutually related, due to the volume of the displaced fluid in the hydraulic actuating system remaining constant.

Therefore, the different lifts of the two intake valves of each cylinder cause a high swirl motion, without worsening the engine volumetric efficiency.

The presence of a hydraulic system wherein the chambers of the two actuators, associated with the two valves, are in communication with a common pressure chamber, represents therefore a sort of hydraulic bridge between the two valves, thanks to which a larger movement of one of the two valves, due to the lesser load of the associated spring, is compensated to the same extent by a smaller movement of the other valve.

If the invention is applied to an engine which is provided with a valve actuating hydraulic system of a simplified kind, without the possibility to vary the lift and/or the time in the opened condition of the valves, in any case fluid supply means are provided which can ensure the compensation of any fluid leakage from the hydraulic system. This fluid supply means preferably comprise a fluid tank connected both to the engine lubrication circuit and to the above-mentioned hydraulic valve actuating system, with the interposition of respective check valves, allowing a fluid flow only from the lubricating circuit towards said tank and only from said tank towards the hydraulic actuating system. The necessary supply pressure may for example be obtained by arranging the tank in an upper position in comparison to the intake valve hydraulic actuating system. Moreover, the above-mentioned tank is preferably closed upwardly by a wall including an air vent opening.

Preferably, moreover, in the case of use of the above-mentioned simplified hydraulic system, the actuating cam of each pair of intake valves has a profile formed so as to slow down the displacement of the intake valves controlled by it in the final part of their closing stroke.

A particularly advantageous application of the invention consists in the intake valve hydraulic actuating system being able to allow a variation of the engine intake valve lifts and/or a variation of the engine angles at which the valve opening and/or closing take place. Preferably, in this case the valve actuating system is of the kind developed by the same Applicant with the trademark MULTIAIR, wherein for each engine cylinder a solenoid valve is provided which controls the communication of the above-mentioned intake valve hydraulic actuating system with a low-pressure exhaust channel, so that, when the solenoid valve is open, the intake valves of a given cylinder are uncoupled from the above-mentioned cam, and are kept closed by said return spring means, and wherein in addition electronic means are provided to control the solenoid valve associated to each engine cylinder, in such a way as to vary the time and/or the engine angles of the respective intake valve opening and/or closing as a function of the engine operating conditions.

BRIEF DESCRIPTION OF THE DRAWINGS

Further features and advantages of the invention will become clear from the following description, discussed in conjunction with the annexed drawings, shown merely for illustrative and not limiting purposes, in which.

DETAILED DESCRIPTION OF PREFERRED EMBODIMENTS OF THE INVENTION

A preferred embodiment of the present invention concerns the application of the above-discussed principles to an engine provided with the variable intake valve actuating system developed by the Applicant under the trademark "MULTIAIR". For a better understanding of this embodiment it is therefore first of all necessary to recall the basic features of the MULTIAIR System.

The "MULTIAIR" System

Figure 1:
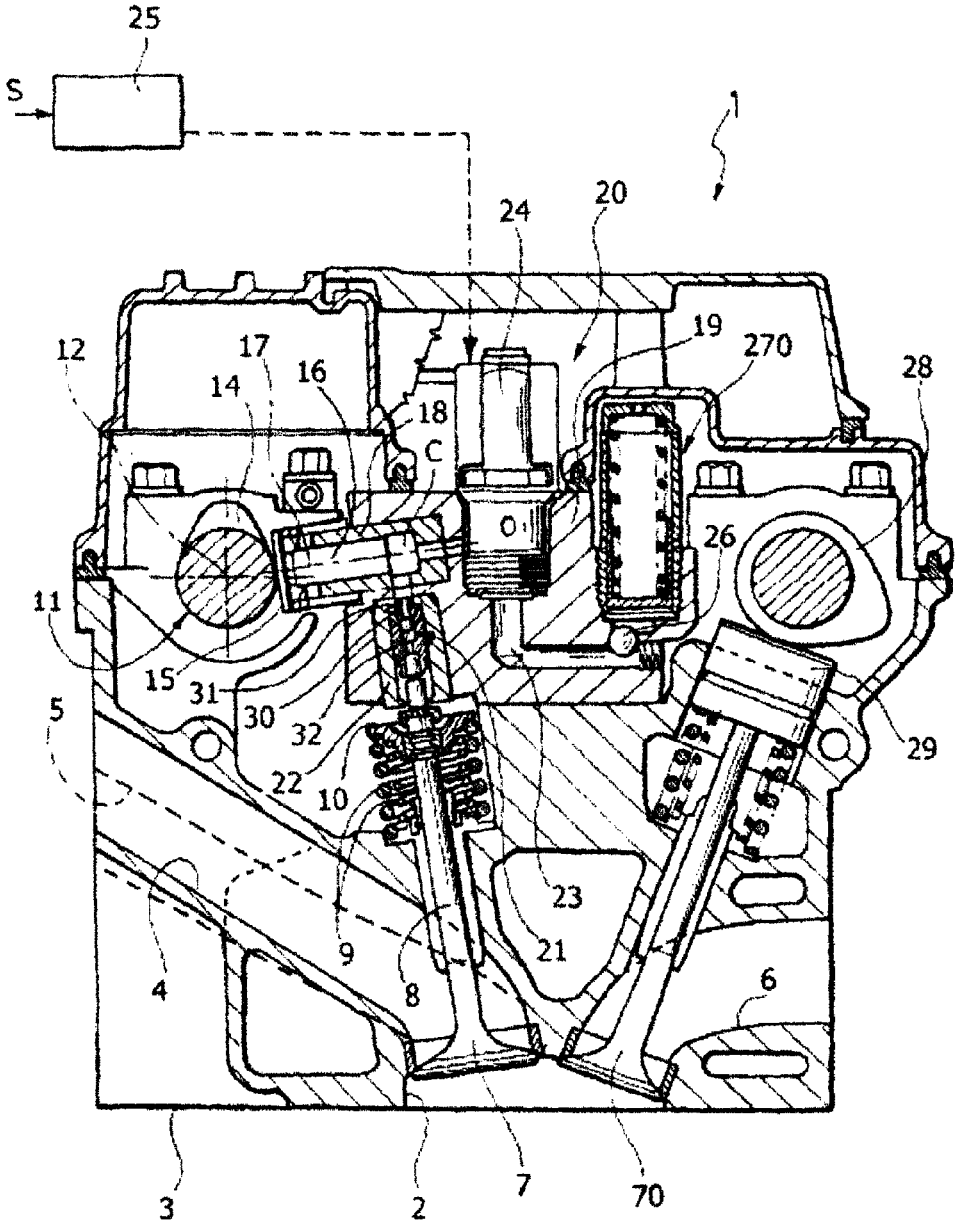
FIG.1 Prior Art
FIG. 1 is a cross sectional view of an engine according to the prior art, of the kind described for example in EP0803642B1 to the same Applicant, which is shown here to illustrate the basic principles of a variable intake valve actuating system of an internal combustion engine of the "MULTIAIR" type.

FIG. 1 of the annexed drawings shows some basic features of the MULTIAIR system, according to what is known from the EP-A-0803642 to the same Applicant. The engine shown in this Figure is a multi-cylinder engine, for example a four cylinder in-line engine, comprising a cylinder head 1. The head 1 includes, for each cylinder, a cavity 2 formed in the bottom surface 3 of the head 1, defining the combustion chamber, into which two intake pipes 4, 5 and two exhaust pipes 6 flow. The communication of the two intake pipes 4, 5 with the combustion chamber 2 is controlled by two intake valves 7, each of which includes a stem 8 slidably mounted in the body of the head 1. Each valve 7 is returned towards its closing position by helical springs 9, interposed between an internal surface of the head 1 and a disk or bowl 10 connected to the valve.

The opening of the intake valves 7 is controlled by a camshaft 11, rotatably mounted around an axis 12 within supports of the head 1, and comprising a plurality of cams 14 for the valve actuation.

Each cam 14 controlling one intake valve 7 cooperates with the cap 15 of a tappet 16 slidably mounted along an axis 17 which, in the case of the shown example, is arranged substantially at 90° to the axis of the valve 7. The tappet 16 is slidably mounted within a bushing 18, born by a body 19 of a preassembled group 20, which embeds all the electric and hydraulic devices associated to the intake valve actuation, according to what will be discussed in further detail later. Tappet 16 can transmit a thrust to the stem 8 of the valve 7, in such a way as to cause the opening of the latter against the action of the spring means 9, by fluid under pressure (typically oil coming from the engine lubricating circuit), which from a chamber C flows to the chamber of a hydraulic actuator associated to the valve 7, where it causes the displacement of a piston 21. Piston 21 is slidably mounted in a cylindrical body consisting of a bushing 22, which is also supported by the body 19 of the sub-group 20. The pressure chamber C can be put into communication with the exhaust channel 23 via a solenoid valve 24. The solenoid valve 24 is controlled by electronic control means, schematically shown at 25, on the basis of signals S that indicate engine operating parameters. The parameters taken into consideration for an intake valve control comprise for example one or two parameters among: gas pedal position, engine rotating speed, room temperature, engine block temperature, engine cooling liquid temperature, pressure in the engine intake manifold, viscosity and/or temperature of the oil in the intake valve hydraulic actuating system.

When the solenoid valve 24 switches from the closed to the open condition, chamber C starts communicating with the channel 23, so that the fluid under pressure in chamber C flows into said channel and an uncoupling is obtained of the tappet 16 from the respective intake valve 7, which therefore rapidly returns to its closing position, under the action of the return valve 9. By controlling the communication between chamber C and the outlet channel 23, it is therefore possible to vary at will the time in the opened condition and the lift of each intake valve 7. Preferably, the solenoid valve 24 is normally open, and it closes when it is energized.

The outlet channels 23 of the plural solenoid valves 24 all flow into one longitudinal channel 26, which communicates with pressure accumulators 270, of which only one is visible in FIG. 1. All the tappets 16 with the associated bushings 18, the pistons 21 with the associated bushings 22, the solenoid valves 24 and the respective channels 23, 26 are supported by and obtained from said body 19 of the pre-assembled group 20, improving the engine assembling time and ease.

The exhaust valves 70, associated to each cylinder, in the embodiment shown in FIG. 1 are conventionally controlled by a camshaft 28 via respective tappets 29, even though as a principle it is also possible, both in the case of the said prior art document and in the present invention, to apply the variable valve actuating system to the exhaust valve control as well.

Always referring to FIG. 1, the variable volume chamber defined within the bushing 22 of the piston 21 (that in the case of FIG. 1 is shown in its minimum volume condition, the piston being in its end-of-stroke position) communicates with the pressurized fluid chamber C through an opening 30 obtained in an end wall of the bushing 22. This opening 30 is engaged by an end snug 31 of the piston 21, in such a way as to bring about a hydraulic braking of the movement of the valve 7 during the closing movement, when the valve is approaching its final closed position, as the oil present in the variable volume chamber is forced to flow into the pressurized fluid chamber C, passing through the play which is present between the end snug 31 and the opening 30 engaged by the same. Beside the communication made up by the opening 30, the pressurized fluid chamber C and the variable volume chamber associated to the piston 21 communicate with each other through inner passages obtained in the piston body 21, and controlled by a check valve 32, which only allows the fluid to flow from the pressure chamber C to the piston variable volume chamber.

During the engine normal operation, when the solenoid valve 24 stops the communication of the pressurized fluid chamber C with the exhaust channel 23, the oil in the chamber transmits the movement of the tappet 16, imposed by the cam 14, to the piston 21 controlling the opening of the valve 7. At an early stage of the opening movement of the valve, the fluid coming from chamber C reaches the variable volume chamber of the piston 21, passing through an axial hole obtained in the snug 30, the check valve 32 and further passages that make the inner cavity of the piston 21, with a tubular shape, communicate with the variable volume chamber. After a first displacement of the piston 21, snug 31 is extracted from the opening 30, so that the fluid coming from chamber C can directly flow into the variable volume chamber through the opening 30, which is now free. In the reverse movement of valve closing, as previously mentioned, during the final stage the snug 31 enters the opening 30, thus causing the hydraulic braking of the valve, in such a way as to avoid an impact of the valve body against its seat when pressure chamber C is devoid of the fluid.

Figure 2:
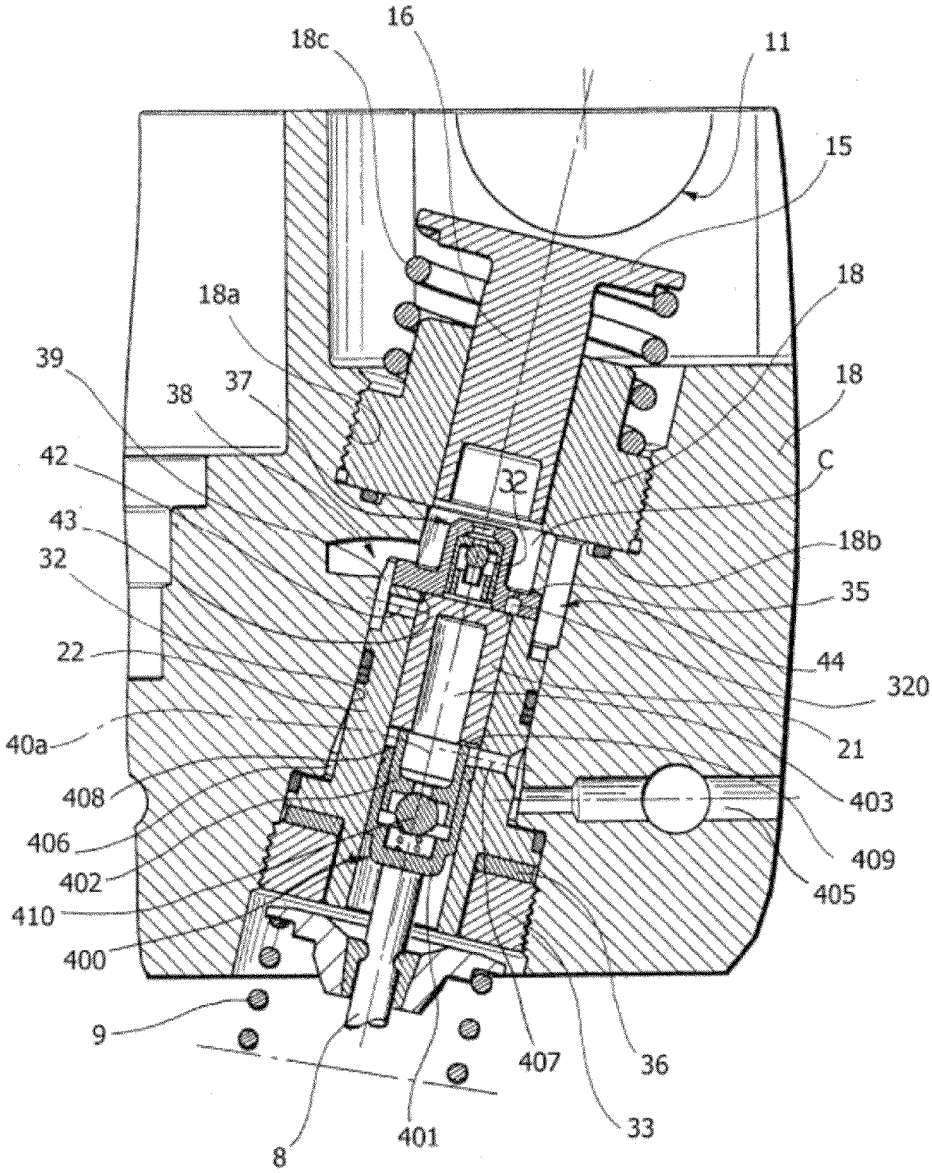
FIG. 2 Prior Art
FIG. 2 is a cross sectional view on an enlarged scale of an auxiliary hydraulic tappet associated to an intake valve of an engine of a similar kind to that of FIG. 1, according to what has already been proposed in EP-A-1344900 to the same Applicant.

FIG. 2 shows the above discussed device in the modified construction which has been proposed in EP-A-1344900 to the same Applicant.

In FIG. 2, the parts in common with FIG. 1 are identified by the same reference number.

A first clear difference of the device in FIG. 2 from the one in FIG. 1 consists in the fact that in FIG. 2 the tappet 16, the piston 21 and the stem 8 of the valve are aligned with one another along an axis 40*a*. It is obvious that the preferred embodiment of the present invention applies in both cases.

Similarly to the solution in FIG. 1, the tappet 16 has its cap 15 cooperating with the cam of the camshaft 11, and it is slidably mounted in a bushing 18. In FIG. 2, bushing 18 is screwed within a threaded cylindrical seat 18*a*, obtained in the metal body 19 of the pre-assembled group 20. A sealing gasket 18*b* is interposed between the bottom wall of the bushing 18 and the wall of the seat 18*a*. A spring 18*a* pulls the cap 15 to contact the cam of the camshaft 11.

In the case of FIG. 2 as well, the same as in FIG. 1, the piston 21 is slidably mounted in a bushing 22 which is received in a cylindrical cavity 32, obtained in the metal body 19, with the interposition of sealing gaskets. The bushing 22 is retained in the mounted condition by a threaded ring 33, which is screwed into a threaded end portion of the cavity 32, and which presses the body of the bushing 22 against an abutment surface 35 of the cavity 32. Between the locking ring 33 and the flange 34 a Belleville washer 36 is interposed, so as to ensure a controlled axial load compensating the differential thermal expansions of the different materials which constitute the body 19 and the bushing 22.

The main difference between the known solution shown in FIG. 2 and the solution, known as well, of FIG. 1 resides in the fact that in FIG. 2 the check valve 32, which allows the passage of pressurized fluid from chamber C to the piston chamber 21, is not supported by the piston 21 but by a separate member 37, which is fixed in relation to the body 19 and which closes upwardly the cavity of the bushing 22, within which the piston 21 is slidably mounted. Moreover, the piston 21 does not have the complicated structure of FIG. 1, with the end snug 31, but it shows the shape of a simple cylindrical member formed as a bowl, with a bottom wall facing the variable volume chamber which receives pressurized fluid from chamber C through the check valve 32.

The member 37 is made up by a ring-shaped plate, which is locked in place between the abutment surface 35 and the bushing end surface 22, due to the clamping of the locking ring 33. The ring-shaped plate is provided with a central cylindrical protrusion that has the function of a housing for the check valve 32, and which has an upper central hole for the fluid passage. In the case of FIG. 2 as well, chamber C and the variable volume chamber defined by the piston 21 communicate with each other through to the check valve 32 as well as through a further passage, made up by a side cavity 38 obtained in the body 19, a peripheral cavity 39 defined by a flattening of the outer surface of the bushing 22, and through an opening (not shown in FIG. 2) of a larger size, and a hole 42 of a smaller size, radially obtained in the wall of the bushing 22. Such openings are shaped and mutually arranged in such a way as to produce the hydraulic braking operation in the final stage of the valve closing, because, when the piston 21 has obstructed the larger sized opening, the hole 42 is still free, intercepting a peripheral end groove 43 defined by a circumferential end slot of the piston 21. In order to ensure that the two said openings correctly intercept the fixed passage 38, the bushing 34 must be mounted at an accurate angular position, which is ensured by an axial pin 44. This solution is preferred to the provision of a circumferential groove on the outer surface of the bushing 22, as this would cause an increase of the oil volume involved, with consequent malfunctions. Moreover, a properly sized hole 320 is provided in the member 37, to make the ring-shaped chamber, defined by the groove 43, communicate directly with chamber C. Such a hole 320 ensures the proper operation at low temperatures, when the fluid (the engine lubricating oil) is highly viscous.

In operation, when it is necessary to open the valve, pressurized oil pushed by the tappet 16 flows from chamber C to the piston chamber 21 through the check valve 32. As soon as the piston 21 has left its upper end-stroke position, the oil can then flow directly into the variable volume chamber through the passage 38 and the two above-mentioned openings (the larger and the smaller, 42), bypassing the check valve 32. In the return movement, when the valve approaches its closed position, the piston 21 initially intercepts the large opening, and then the opening 42, causing the hydraulic braking. A properly sized hole can also be provided in the wall of member 37, in order to reduce the braking effect at low temperatures, when the oil viscosity could cause an excessive braking of the valve movement.

As can be seen, the main difference with reference to the solution shown in FIG. 1 resides in the production steps of the piston 21 being much simpler, as the latter shows a far less complicated structure than in the solution of FIG. 1. The solution in FIG. 2 also allows to decrease the oil volume in the chamber associated to the piston 21, which produces a smooth valve closing movement, without hydraulic rebounds, a reduction of the time needed for the closing, a reliable working of the hydraulic tappet, without pumping, a fall of the impulsive force in the engine valve springs and a decrease in hydraulic noise.

A further feature of the known solution shown in FIG. 2 resides in the provision of a hydraulic tappet 400 between the piston 21 and the valve stem 8. The tappet 400 comprises two concentric slidable bushings 401, 402. The inner bushing 402 defines, together with the inner cavity of the piston 21, a chamber 403 that is fed with pressurized fluid through passages 405, 406 in the body 19, a hole 407 in the bushing 22 and passages 408, 409 in the bushing 402 and in the piston 21.

A check valve 410 controls a central hole in a front wall on the bushing 402.

Figure 3:
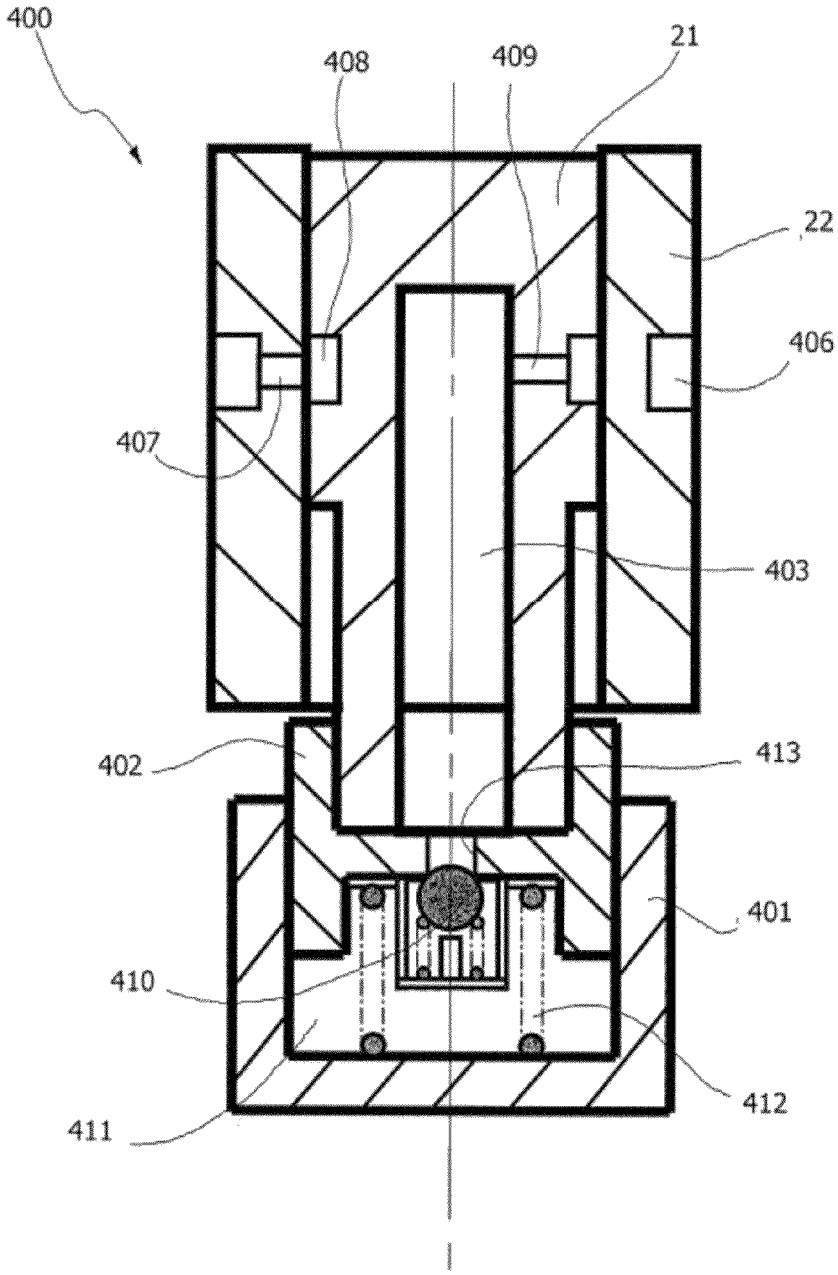
FIG. 3 Prior Art
FIG. 3 is a schematic cross-sectional view of the auxiliary hydraulic tappet associated to the actuator of each intake valve of the engine, according to EP1674673A1 to the same Applicant.

A further improvement, known as well, is shown in FIG. 3. This figure shows a schematic cross-sectional view of the end part of the control piston 21 of a variable actuating valve, and the respective guide bushing 22, as well as the auxiliary hydraulic tappet 400 associated with the actuating group, made up bay the piston 21 and the bushing 22. As can be clearly seen in FIG. 3, the main difference compared to FIG. 2 is that the auxiliary hydraulic tappet 400 is located completely outside the engine valve actuating group. More precisely, the first bushing 401 of the auxiliary hydraulic tappet 400 is not located inside the guide bushing 22. Thanks to this feature, the sizing of the guide bushing 22 is totally independent from the size of the auxiliary hydraulic tappet 400. This is an advantage because, if one wishes to use a commercially available, conventional hydraulic tappet of any kind, the outer diameter of such a tappet cannot be reduced beyond a certain limit. On the other hand, the diameter reduction of the guide bushing 22 is advantageous in that such a decrease in diameter causes a reduction of the oil amount which must flow outside the hydraulic actuator chamber of the valve when the engine valve must close. It is thus possible to achieve a substantial reduction of the valve closing time, with consequent advantages in terms of efficient engine operation, as compared to the solution of FIG. 2.

Still referring to FIG. 3, the inner chamber 403 of the hydraulic tappet is fed with oil from the engine lubricating circuit in a similar way to what shown in FIG. 2. The oil coming from a supply channel 406 (FIG. 2) enters a circumferential chamber 406 (FIG. 3) defined by a peripheral outer groove of the guide bushing 22. From such a circumferential chamber 406 the oil flows, through a radial hole 407 provided in the wall of the guide bushing 22, into a peripheral chamber 408 defined by a circumferential groove of the outer surface of the piston 21. Hence the oil flows into the chamber 403 through a radial hole 409 provided in the wall of the piston 21. The communication between the chamber 403, defined between the piston 21 and the bushing 402, and the chamber 411 defined between the two bushings 401, 402, is controlled by the check valve 410, subjected to the action of the return spring 412.

The operation of the actuating group 21, 22 of the auxiliary hydraulic tappet 400 is quite similar to what has been previously described referring to FIGS. 1, 2. In the case of the solution shown in FIG. 3, both bushings 401, 402 which make up the auxiliary hydraulic tappet 400 are arranged outside the guide bushing 22 of the actuating piston 21.

Figure 4:
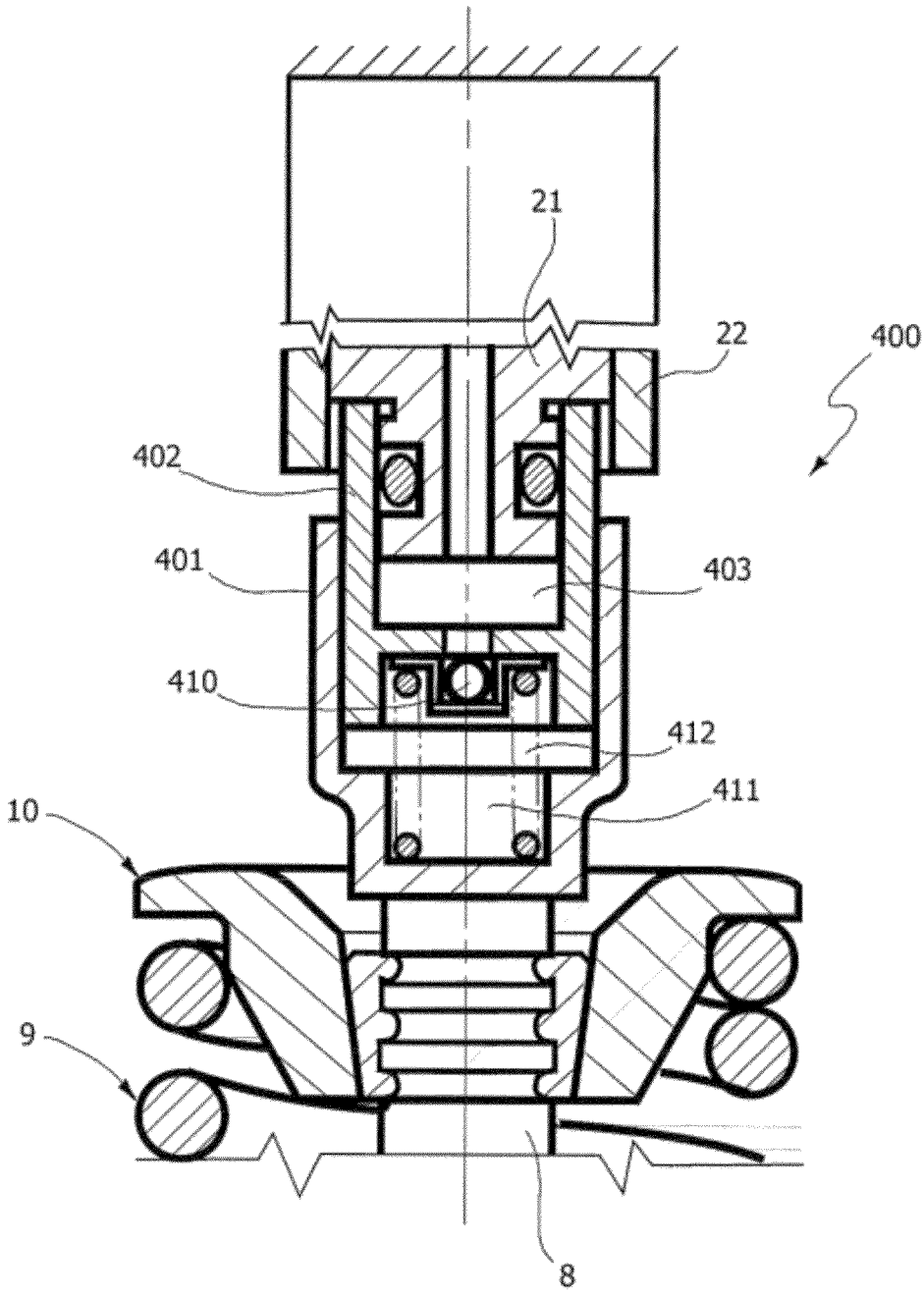
FIG. 4 Prior Art
FIG. 4 is a view similar to FIG. 3, showing a constructive solution also known from EP 1674673A1.

FIG. 4 shows a variation, known as well, very similar in principle to the solution of FIG. 3, which however differs from it due to the fact that only the bushing 401 of the auxiliary hydraulic tappet 400 is arranged outside the guide bushing 22, while the bushing 402 is mounted inside. Else, the solution shown in FIG. 4 differs from the solution only schematically shown in FIG. 3 only in constructive details. FIG. 4 also partially shows the upper end of the valve stem 8 with the respective return spring 9 and the respective stop disk 10 which bears the spring 9.

Figure 5:
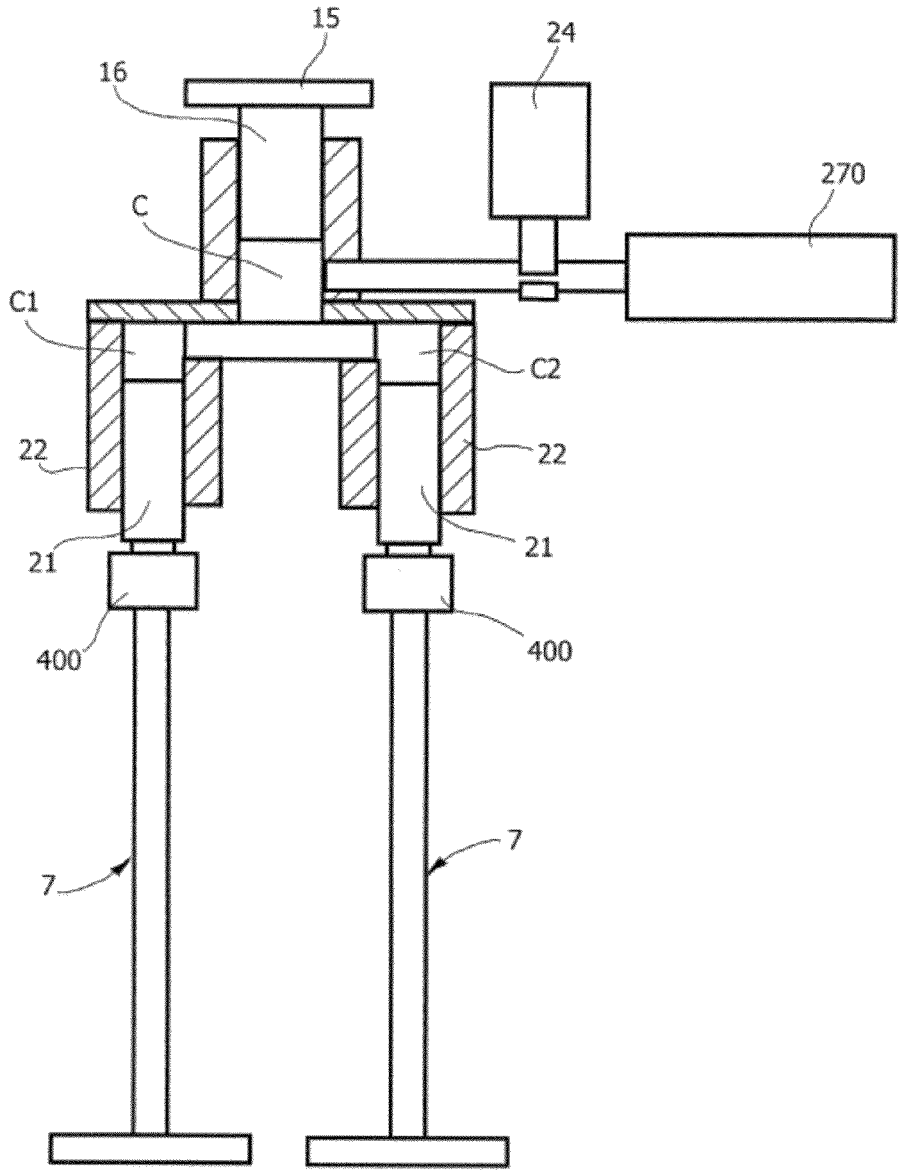
FIG. 5 Prior Art
FIG. 5 is a schematic view of a valve actuating system also known from EP1674673A1, with two intake valves per cylinder which are actuated by a single cam, via a hydraulic bridge.

FIG. 5 is a schematic view of a further design of the MULTIAIR system, proposed by the same Applicant in EP1674673A1. In this Figure, the parts which are common with the previous Figures are assigned the same reference number. FIG. 5 shows two intake valves 7 associated with one cylinder of an internal combustion engine, which are controlled by a single pumping piston 16, which in turn is actuated by one cam (not shown) of the engine camshaft, which acts against its cap 15. The Figure does not show the return springs 9 (see FIG. 1) which are associated to the valves 7 and which tend to return them to their respective closed positions. Auxiliary hydraulic tappets 400, similar to those shown in FIG. 4, are associated to the hydraulic actuators 21.

In the system of FIG. 5, one pumping piston 16 controls the two valves 7 of each cylinder through a single pressure chamber C, whose communication with the exhaust is controlled by a single solenoid valve 24. This solution offers advantages in terms of a simple and unexpensive design and a possible downsizing. The single pressure chamber C works as a master cylinder chamber, in fluid communication with both variable volume chambers C1, C2 of the hydraulic actuators associated to the two valves 7.

The system of FIG. 5 can operate efficiently and reliably especially in the case where the volumes of the hydraulic chambers are relatively small. Such a possibility is offered by the arrangement of the hydraulic tappets 400 outside the bushings 22, according to what has already been explained with reference to FIG. 4. In this way, the bushings 22 may have an inner diameter which can be selected as small as wished. Of course, this option is in any case to be considered as preferred only, and not as essential.

Figure 6:
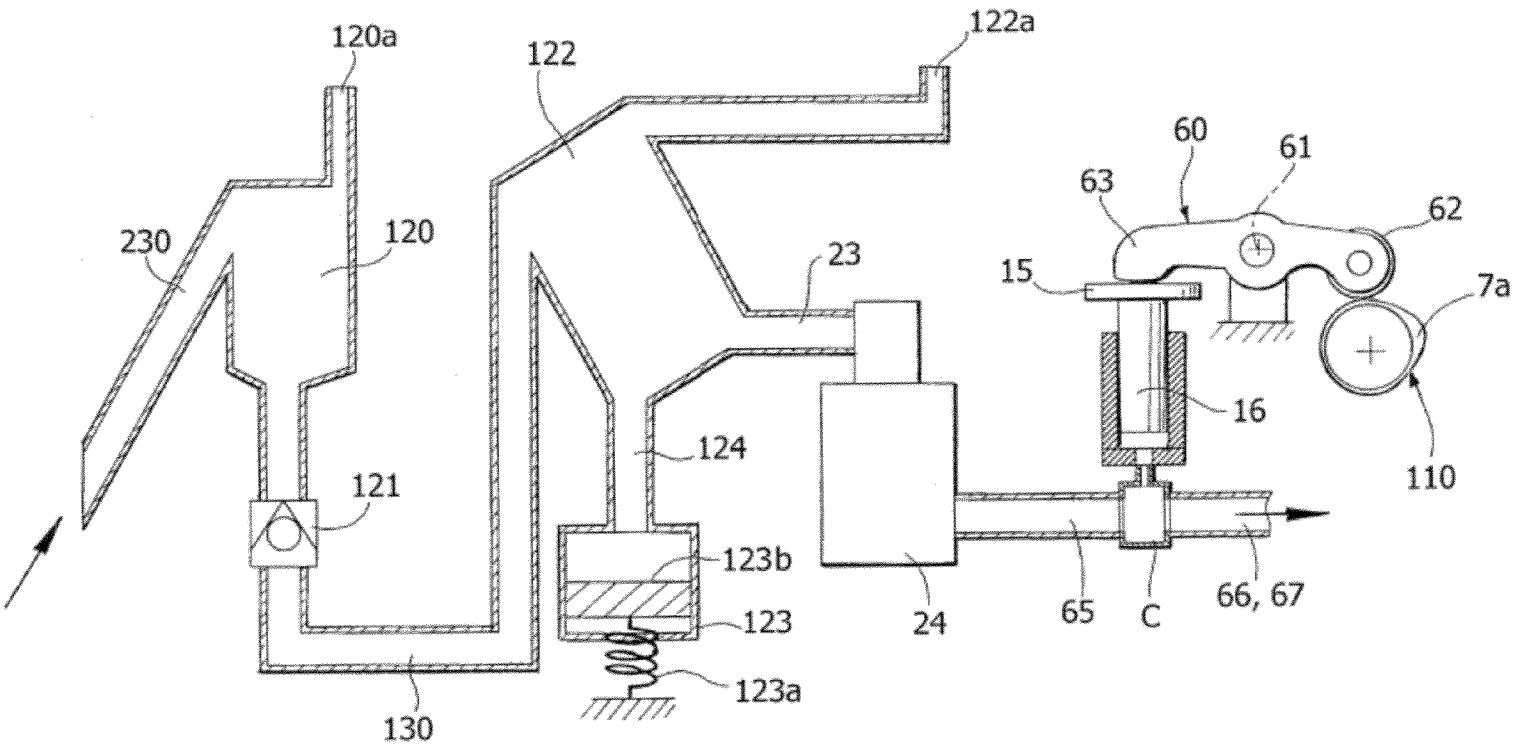
FIG. 6 Prior Art
FIG. 6 is a further schematic view of the hydraulic supply circuit used in the MULTIAIR system, according to what is already known from EP1555398 B1 to the same Applicant.

Further meaningful features of the MULTIAIR system, which are applicable to the present invention as well, are shown in FIG. 6 of the annexed drawings, which shows the hydraulic circuit as a whole, in itself known from EP1555398B1.

As can be seen in FIG. 6, the system comprises vent means for the air that builds up in the intake valve hydraulic control device, due for example to a long stay of the vehicle with switched-off engine. When starting the engine, the oil coming from the engine lubricating circuit flows to the pressure chamber C after passing a first additional tank or silo 120, a check valve 121, a second additional tank or silo 122, which communicates with an accumulator 123 (corresponding to the accumulator 270 in FIG. 1) and the passage 23 controlled by the solenoid valve 24 (which in the presently discussed embodiment is normally open). The tanks 120 and 122 have vents 120*a* and 120*b*, respectively. The system shown in FIG. 6 involves a simple capacity (tank 120) upstream the check valve 121 (with reference to the fluid flow direction at engine start, when the oil coming from the lubricating circuit gets to fill the intake valve hydraulic control circuit), with the mouth of the inflow channel 230 in the upper part of the tank 120 and the tank outflow arranged on its bottom, in such a way as to obtain a "siphon" effect that allows to vent the air present in the pipe. In the practical application, the vent hole 120*a* may be arranged in a remote position from the silo 120. The oil fed to the silo 120 flows towards a pipe 130 that branches off from the bottom of the silo 120, thus venting the contained air into the atmosphere. After passing the check valve 121, the oil gets to the second silo 122, where the additional air that may be present vents into the atmosphere through an opening 122*a* (which in the practical application may be located remotely from the silo 122). The silo 122 communicates, through a channel 124, with the hydraulic accumulator 123, whose capacity is filled by displacing a piston 123*b* against the action of a spring 123*a*.

PREFERRED EMBODIMENT OF THE INVENTION

Figure 7:
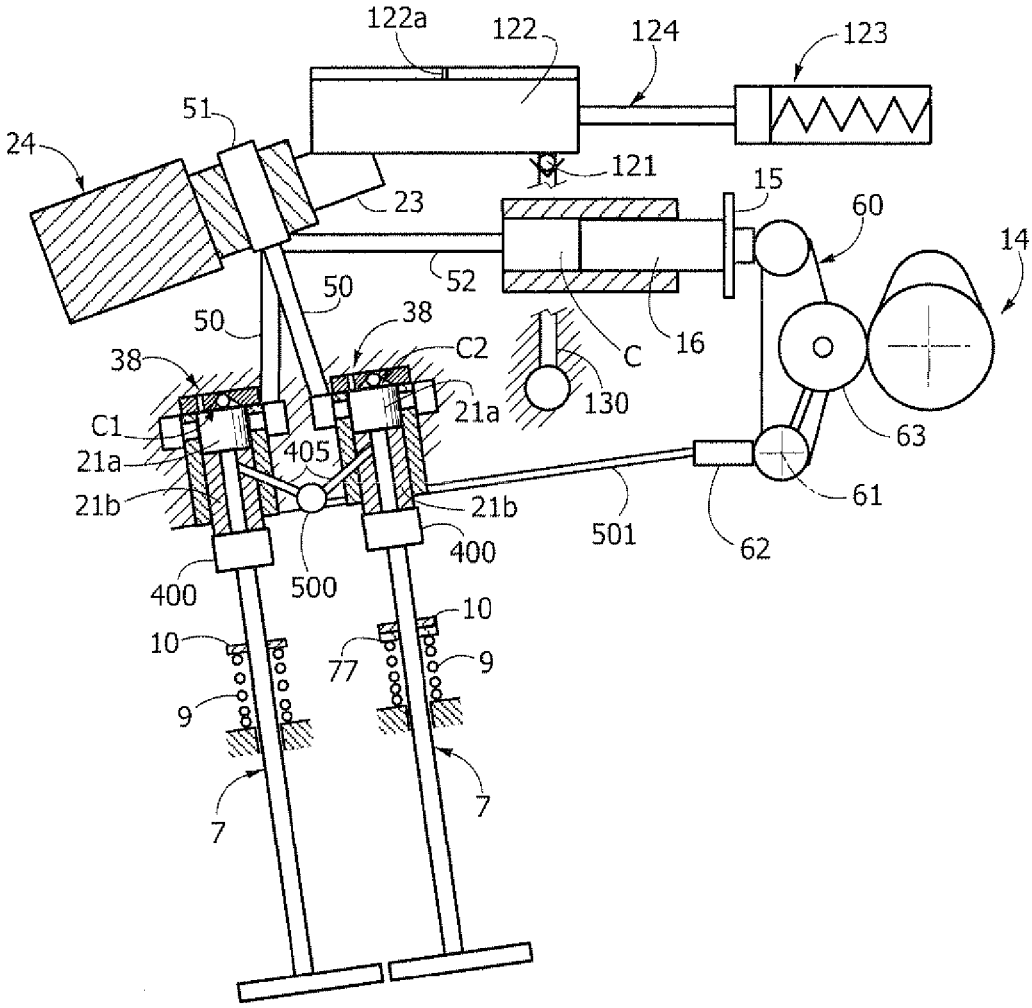
FIG. 7 shows a first embodiment of the invention, wherein there is provided a variable valve actuating system.

FIG. 7 shows a preferred embodiment of the engine according to the invention, wherein the principles of the invention are applied to a motor provided with the MULTI-AIR system. In this Figure, the parts corresponding to those illustrated in FIGS. 1-6 are assigned the same reference number. Basically, FIG. 7 shows a variable actuating system of the two intake valves associated to each cylinder, of the same kind as shown in FIG. 5. The embodiment of FIG. 7 refers specifically to a two-cylinder small displacement gasoline engine, although it must be noted that the schematic drawing in FIG. 7 may be considered in association with a cylinder of any engine. The two intake valves 7 of each cylinder are controlled, with the interposition of the auxiliary hydraulic tappets 400 (for example of the known kind shown in FIG. 4) by two hydraulic actuators with pistons 21 and related hydraulic braking devices 38, for example of the same known type shown in FIG. 2. The variable volume chambers C1, C2 of the two hydraulic actuators, facing the pistons 21 (which in the shown example are each made up, for constructive requirements, by two separate bodies 21*a*, 21*b*), communicate with a chamber 51, which in turn is connected, via a channel 52, with the pressure chamber C associated with the pumping piston 16 of the master cylinder. Similarly to the above-described known solutions, the cap 15, stiffly connected to the pumping piston 16, is controlled by a single cam 14, in this case with the interposition of a rocking lever 60 which is pivotally mounted at one end thereof, at 61, on the engine structure, through a hydraulic support device 62 known in itself. The rocking lever 60 has an intermediate portion thereof supporting in a freely rotatable state a needle 63, which cooperates with the cam 14 and has its end opposed to the pivoting end, at 61, cooperating with the cap 15. The above-mentioned arrangement is provided in combination with the pumping piston 16 being oriented along a horizontal axis, with the aim of reducing the vertical dimensions as much as possible. Similarly to what has been shown in FIG. 5, the solenoid valve 24 controls the communication of the pressure chamber C (through the pipe 52 and the chamber 51) with the exhaust channel 23, communicating with a tank 122 closed at the top by a wall having an air vent hole 122*a* and communicating moreover with the pressure accumulator 123 through the pipe 124. The tank 122 communicates through the check valve 121 with a pipe 130, upstream of which there is provided a siphon device similar to the device 120 of FIG. 6, as well as preferably a filter.

Oil supply to the auxiliary hydraulic tappets 400 is effected through pipes 405, communicating with a channel 500 connected to the engine lubricating circuit. The same channel feeds oil, through a further channel 501, to the support 62 as well.

Figure 8:
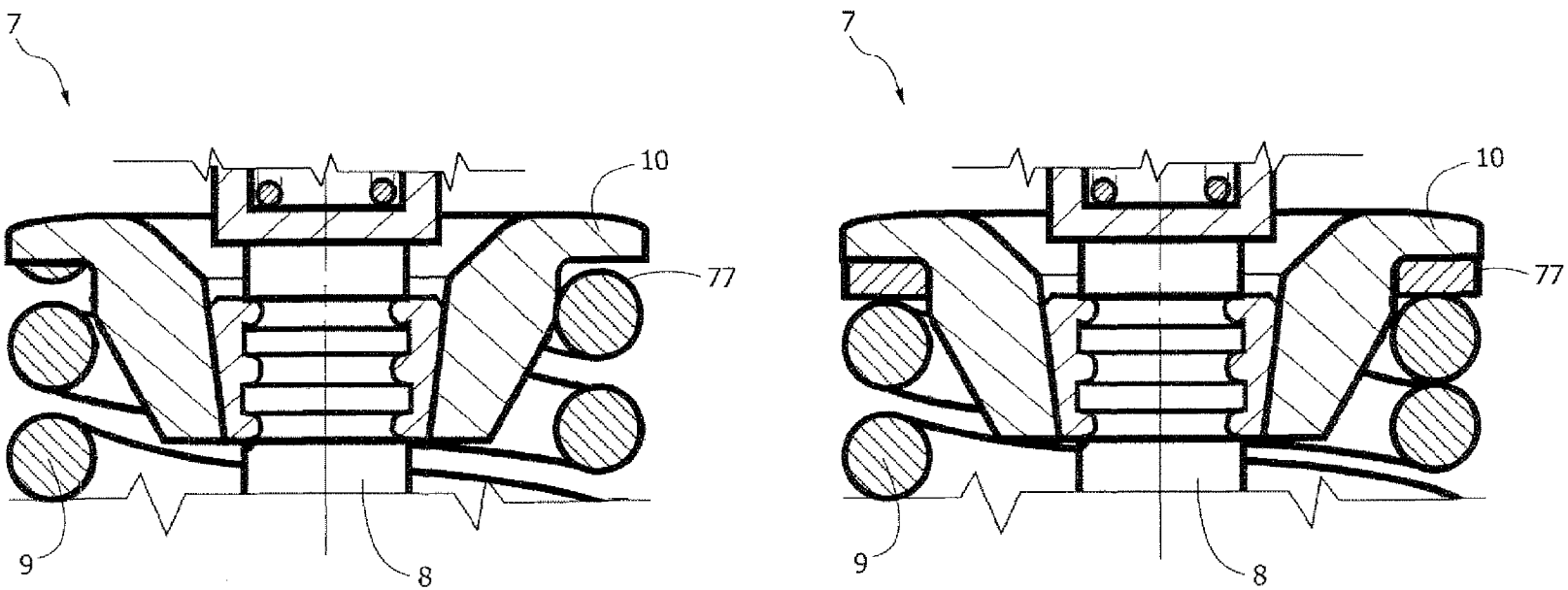
FIG. 8 shows a detail of FIG. 7.

FIG. 7 shows the return springs 9 associated to the two valves 7, and the respective stop disks or bowls 10. As can be seen more clearly in detail in FIG. 8, each of the two intake valves 7 of each cylinder is provided with a single helical spring 9, whose upper end bears against the respective element 10. According to the presently shown embodiment of the invention, the two helical springs 9 associated with the two intake valves 7 of each cylinder are identical, but have different predetermined loads. This is achieved, in the exemplary case described in FIG. 8, by interposing between the end of one of the two springs 9 and the respective stop element 10 a shim or spacing ring 77. As a consequence of the provision of such a spacing ring 77, when both intake valves are closed, the two respective helical springs 9 are subjected to different predetermined loads.

The provision of such a feature, combined with the construction of the hydraulic valve actuating system, allows the achievement of significant advantages. As a matter of fact, the differential load of the springs associated with the two intake valves causes, for a given displacement of the pumping piston 16 determined by the cam 14, the displacement of the two valves with mutually different times and lifts, which allows to impart a strong swirl motion to the charge introduced into the cylinder. At the same time, the hydraulic communication between chamber C of the master cylinder and the chambers C1, C2 of the two hydraulic actuators, in the closed condition of the solenoid valve 24, ensures the mutual compensation of the movements of both intake valves, as the asymmetrical movements of the two valves take place with a constant volume of the oil present in the hydraulic system. Compared with the presence of equally loaded springs 9, the amount of extra oil entering one of the two hydraulic actuators equals indeed the lower amount of oil flowing into the other actuator. As a consequence, the two valves show a differential lift which is proportional to the differential load of the related return springs 9, but the average lift of both valves equals the lift which would be obtained with springs having the same load.

Therefore, the differentiated lifts of the two cylinder valves cause a high swirl motion without impairing the engine volumetric efficiency, thanks to the mutual compensation of the two valve lifts due to the provision of a hydraulic valve actuating system.

Figure 10:
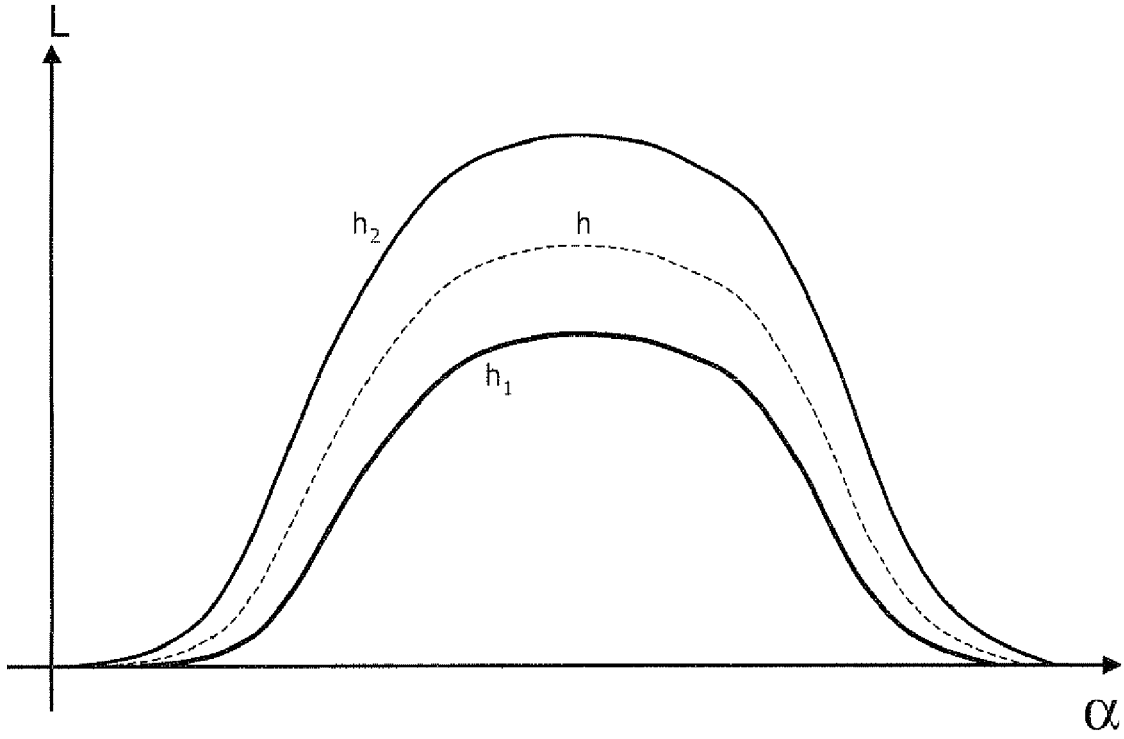
FIGS. 10-12 and 13A, 13B, 14A, 14B are diagrams showing the operating principle and the features of the engine according to the invention.

FIG. 10 of the annexed drawings shows the differentiated lifts $h_1$ and $h_2$ of the valves 7, due to the different loads of the springs 9 associated to the two intake valves. The curve h shows the lift both valves would have if the loads of the springs 9 were equal. Indicating with $\Delta F$ the difference of the loads of both valves 9, and with k the value of their elastic constant (identical for the two springs), it is true that the difference $h_2-h_1$ is proportional to $\Delta F/k$, and that $h=(h_1+h_2)/2$. In other words, per engine angle the average of the values $h_1$ and $h_2$ equals the lift h which both valves would show if they were provided with equal springs with equal loads.

Figure 11:
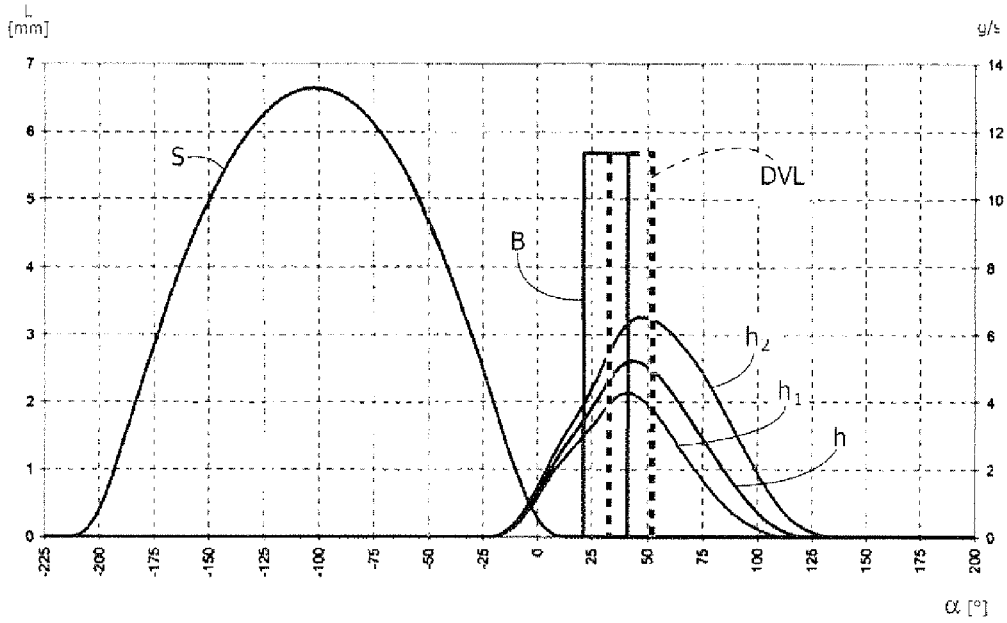

The diagram in FIG. 11 concerns a concrete case of application of the invention to an engine whose ignition is controlled by direct fuel injection, with a variable valve actuating system of the above described kind. The diagram concerns the engine operating condition at a steady state of 4000 rpm, with an average effective pressure of 3 bar. FIG. 11 shows both the exhaust valve lift of a given cylinder (line S) and the differentiated profiles of the lifts $h_1$ and $h_2$ of the intake valves 7, as well as the base profile h, which would occur in the case of identical loads of the return springs associated with the two intake valves. FIG. 11 also shows the injected gasoline flow rate (expressed in grams per second) as a function to the varying engine angle, both in the case of undifferentiated lifts (line B) and of differentiated lifts (line DVL). Tests have ascertained that both the solution with symmetrical lifts and the solution according to the invention, with differentiated lifts, achieve the same engine load (3 bar average effective pressure). The simulation through hydrodynamic calculation applied to the specific above described case has shown a well-structured swirl motion, in contrast to the initial case, which does not show a swirl motion around the cylinder axis.

It has moreover been ascertained that the swirl motion of the charge introduced into the combustion chamber, created in the intake stage by the differential lifts of the two intake valves, in the subsequent compression step converts into a higher turbulence and into a higher homogeneity of the air-fuel mixture, as compared to the initial case with symmetrical lifts.

Figure 12:
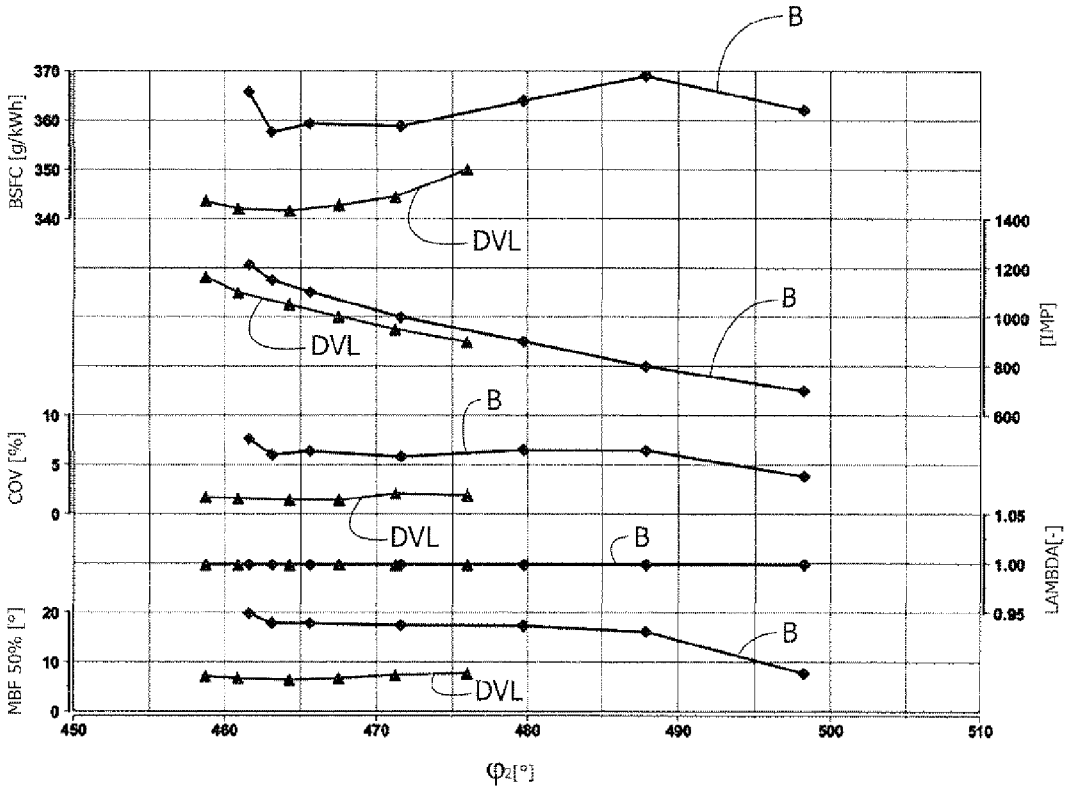

FIG. 12 shows the consumption, speed and combustion steadiness values calculated for the said engine in the same situation of load and simulated steady state (3 bar average effective pressure and 4000 rpm) as a function of the variation of the mean closing point $\Phi_2$ of the intake valve (meaning the engine angle value at which the valve closes) and of the variation of the supercharge pressure in the intake manifold. Lines B refer to the basic case with symmetrical lifts of both valves, while lines DVL refer to the invention, with asymmetrical lifts.

In FIG. 12, the symbols have the following meanings:

BSFC: Brake Specific Fuel Consumption, measured in g/kWh

COV: Covariance, in percentage,

MBF 50%: Mass Burnt Fraction, in degrees,

LAMBDA is the ratio of the air-fuel ratio to the stoichiometric ratio,

IMP: Intake Manifold Pressure.

The diagram in FIG. 12 shows that the higher homogeneity and turbulence achieved in the case of differentiated lifts produces a higher speed and combustion steadiness, which actually cause a dramatic fall of the fuel consumption (BSFC).

Remarkable advantages due to the differentiated movement of the intake valves are obtained for diesel engines as well, where the swirl motion acquires great significance in reducing polluting emissions.

Referring back to the basic features of the present invention, it should be noted that Paragraph 38 of the document EP1674673A1 mentions the possibility that, in a system of the kind shown in the annexed FIG. 5, the loads of the springs associated with the two engine valves may be slightly different. In that case such possible differences, which could be due for instance to mounting errors and/or to manufacturing tolerances, were not desirable, they amounted to a small uncontrolled quantity and were considered to be harmful. Such circumstance therefore further proves the inventive principle of the presently described solution, wherein, against the previous technical prejudice, the differentiated load of the springs is instead sought for and accurately predetermined in a controlled way, in order to achieve the above discussed advantages. It is moreover clear that such advantages are also achievable by differentiating the springs associated with the two intake valves also by different means, for example making use of springs with different flexibility (i.e. different elastic constants) or providing both differences (different load and different flexibility).

FURTHER EMBODIMENT OF THE INVENTION

From the foregoing it is clear that the advantages of the invention are achievable only in the case of an engine whose intake valves are actuated by a hydraulic system. The above description focuses on the preferred embodiment of the invention, wherein the hydraulic actuating system is adapted to effect a variable actuation of the valves, according to the previously detailed solutions. As a matter of fact, in this specific embodiment, the invention deploys its most significant advantages, as it allows to combine effectively a combustion optimization, achieved through the improvement of the swirl motion, with the advantages of a reduction of consumption and harmful emissions, determined by the variable actuating system, with the result that these advantages mutually combine in synergy to produce an engine which is really optimal in terms of combustion and emissions, without jeopardizing performance.

Figure 9:
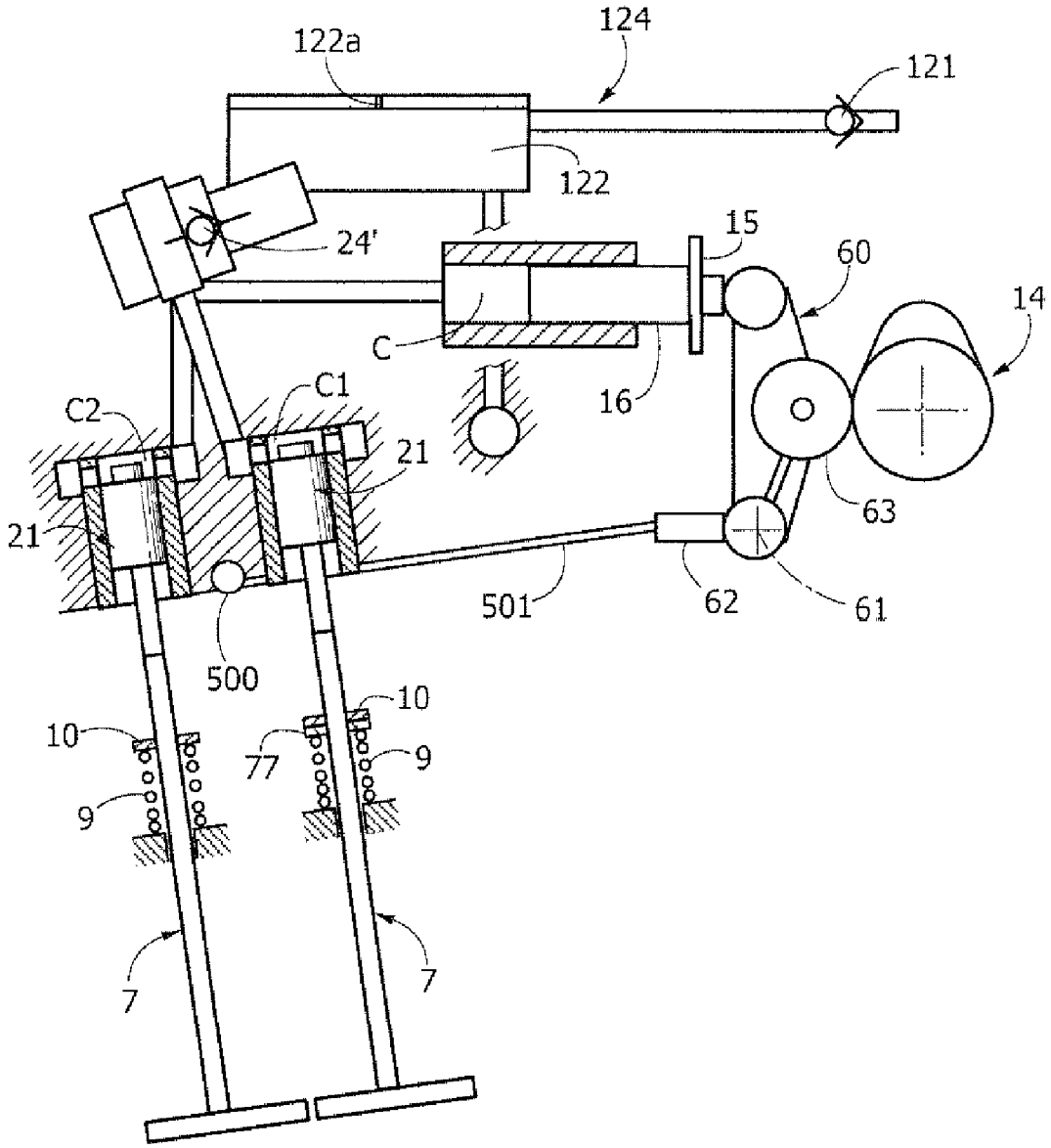
FIG. 9 shows a second embodiment of the invention, where the valves have a "fixed" actuation.

It must be clearly stated, however, that the invention shows evident advantages also with a hydraulic valve actuating system that does not allow a variable actuation of the valves but is substantially isolated from the exterior. An exemplary system of this kind is shown in FIG. 9. This Figure schematically shows an engine which basically consists of an engine corresponding to the solution shown in FIG. 7, through the elimination of a few components and a simplified construction. In comparison with the case of FIG. 7, the engine of FIG. 9 is simplified because it does not have a variable valve control system. The solenoid valve 24 is not present and it is substituted for by a simple permanent communication, through a check valve 24', with the tank 122 (the parts in common with FIG. 7 are assigned in FIG. 9 with the same reference number). Both hydraulic actuators have neither a hydraulic brake (which is present on the contrary in the case of FIG. 7) nor auxiliary hydraulic tappets. In any case, the presence is retained of a hydraulic system made up of a master cylinder with pressure chamber C, in permanent communication with the chambers C1, C2 of the two hydraulic actuators. The tank 122 is in any case arranged in an upper position with reference to the hydraulic system, so as to ensure a fluid supply pressure, which allows to compensate possible losses due to fluid leaking out of the hydraulic system. The tank 122 communicates with the engine lubricating circuit through a check valve 121, which only allows a flow towards the tank 122, and through a filter (not shown). In the case of FIG. 9 as well, the return springs 9 associated to the intake valves 7 show an arrangement similar to what shown in FIG. 8, with a spacing ring 77 associated to only one of them, so as to create the load difference causing the different lifts of both valves, according to what has been explained extensively in the foregoing, with reference to the solution of FIG. 7.

As stated before, in the case of the simplified solution in FIG. 9, the two hydraulic actuators associated with the intake valves 7 do not have a hydraulic brake. However, with the aim to provide a proper operation of the system, and in particular a proper closing of the valves, the cam 14 is preferably designed with such a profile as to slow down the intake valve displacement in the final stage of their closing stroke. As an alternative, it is in any case possible, in the simplified system of FIG. 9 as well, to provide hydraulic braking systems in combination with the two hydraulic actuators associated with the intake valves 7.

Figure 13A:
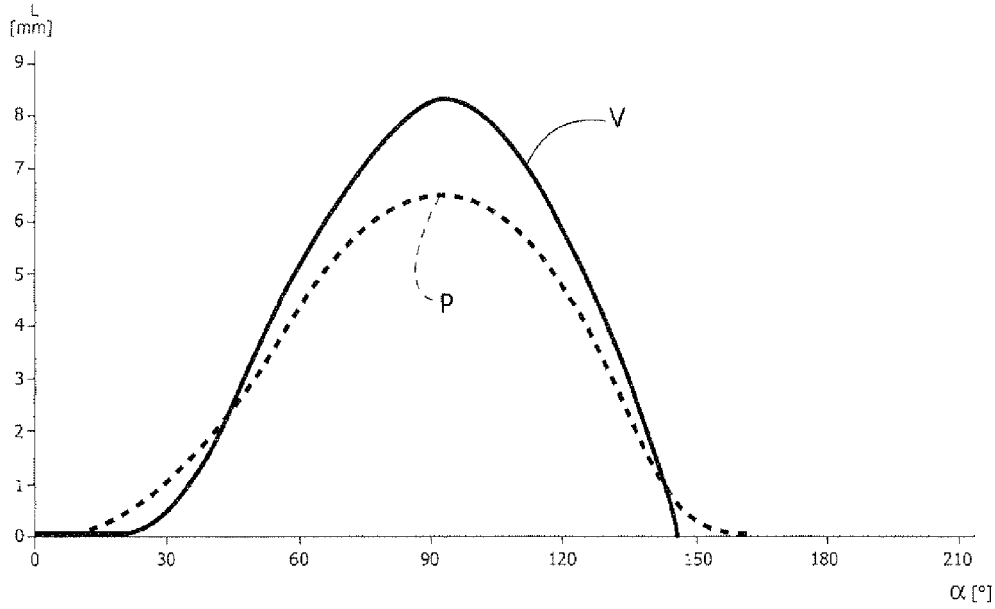

FIGS. 13A e 13B show, with line V, the lift of the valve 7 and the displacement speed of the valve 7, in the case of a practical solution tested by the Applicant, with a conventional cam profile. Lines P show the displacement and the speed of the pumping piston 16.

Figure 13B:
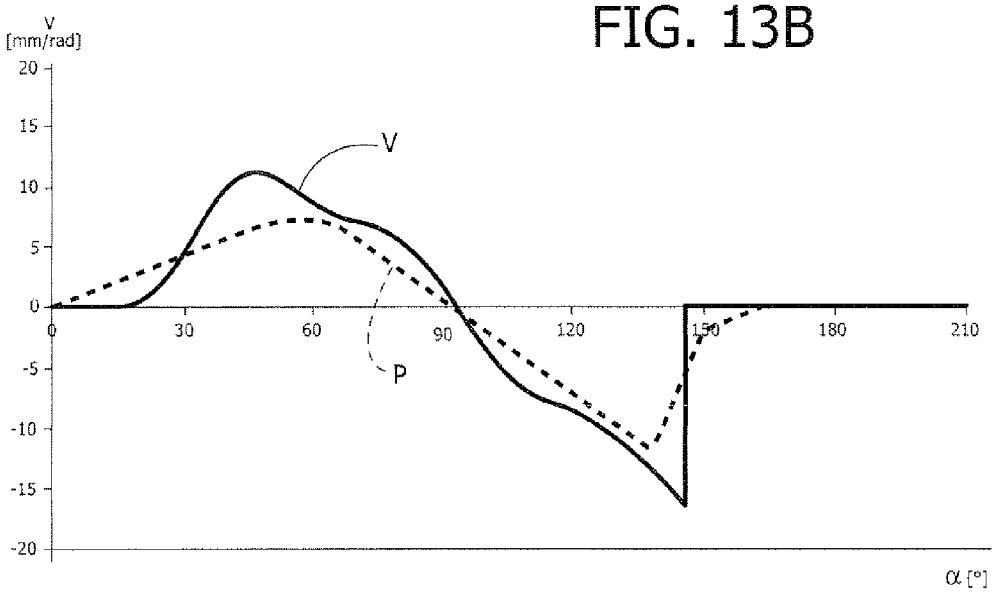
Figure 14A:
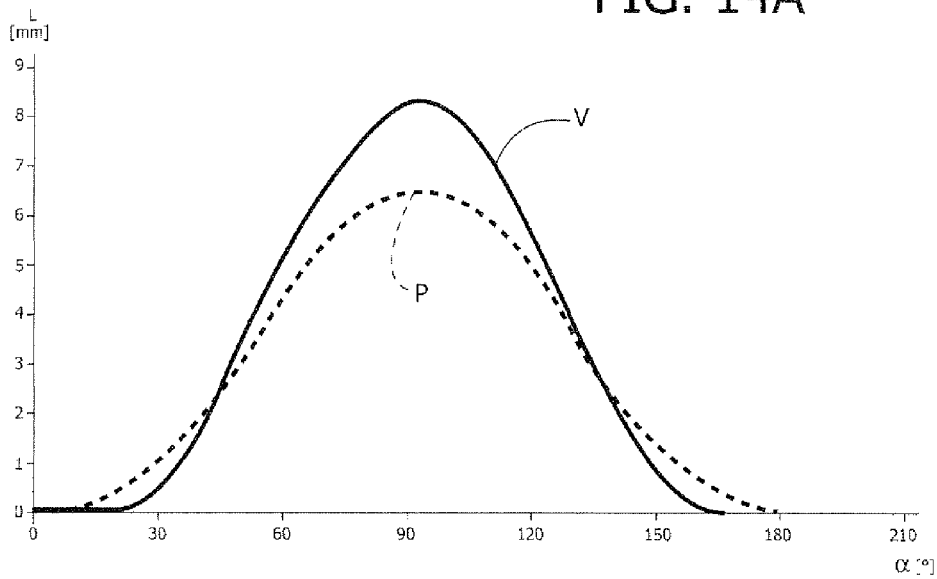
Figure 14B:
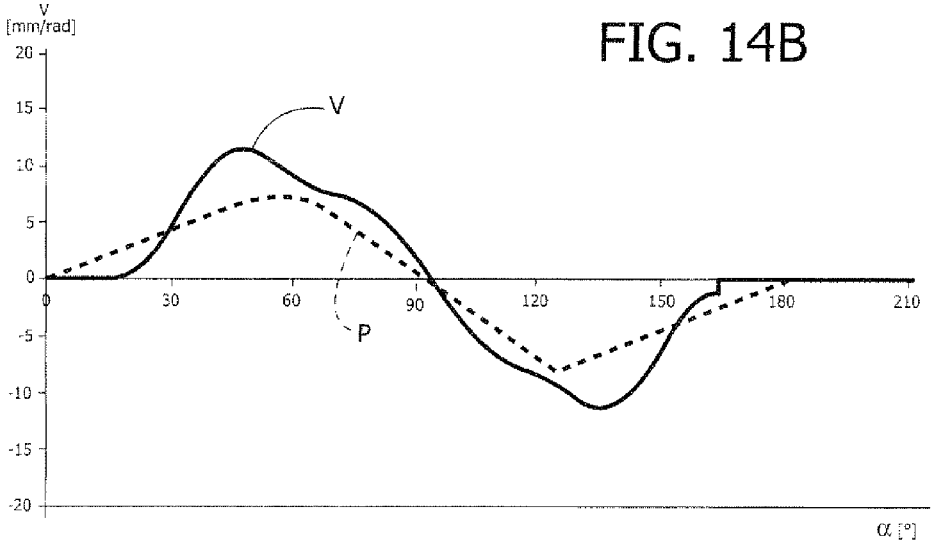

In the diagrams of FIGS. 13*b*, 14*b*, the speed is indicated in mm per cam rotation radian. The values expressed in mm/rad may be converted in mm/s values for a given engine rotation speed. For this particular case, wherein the speed was 6500 rpm, it is evident from FIG. 13*b* that the valve closing takes place in this case at a speed of 5 m/s, which involves an excessive impact and does not ensure a long operating life.

FIGS. 14A and 14B show, with the lines V and P, the displacement and the speed of the valve 7 and of the pumping piston 16, with a modified cam profile according to the invention. The valve closing occurs in this case more gradually, with a final speed which, for the case considered of 6500 rpm, is 0.5 m/s, and takes place with an engine angle which is delayed by 17° in comparison with the previous case. A long operating life of the system is thus ensured, despite the absence of a hydraulic brake.

Of course, on the basis of the found principle, the constructive details and the embodiments may vary, even conspicuously, from what has been described and illustrated in the foregoing, by way of example only, without departing from the scope of the present invention.

What is claimed is:

1. An internal combustion engine, comprising at least two intake valves per engine cylinder, each provided with respective return springs which push the valves towards a closed position, wherein the intake valves of each engine cylinder are controlled by a single cam of an engine camshaft, via a single tappet actuated by said cam and through a hydraulic system comprising a master cylinder, having a piston operatively connected to said tappet and two hydraulic actuators respectively associated with the two intake valves and both hydraulically connected to a common pressure chamber of said master cylinder, wherein the return springs associated with the two intake valves of one and the same engine cylinder are arranged so as have an accurately predetermined and controlled difference in load and/or flexibility, so that said intake valves of each cylinder have lift profiles which are different from each other, and so that at each crank angle of the engine the average of the values h1 and h2 of the lifts of the two valves equals the theoretical lift h which each valve would show in case of springs with equal load and flexibility.

2. The engine according to claim 1, wherein said hydraulic system is in communication with fluid supply means adapted to ensure the compensation of fluid leaks from the hydraulic system.

3. The engine according to claim 2, wherein said fluid supply means comprise a fluid tank, connected both with the engine lubricating system and with an intake valve hydraulic actuating system, with the interposition of respective check valves, which allow the fluid to flow only from a lubricating circuit towards said tank and only from said tank towards the intake valve hydraulic actuating system.

4. The engine according to claim 3, wherein said tank is arranged above said intake valve hydraulic actuating system.

5. The engine according to claim 3, wherein said tank is closed upwardly by a wall including an air vent opening.

6. The engine according to claim 3, wherein in the connection between said fluid tank and the engine lubricating circuit a filter is interposed.

7. The engine according to claim 1, wherein each of said hydraulic actuators comprises hydraulic braking means, in order to slow down the displacement of the respective intake valve in the final stage of its closing stroke.

8. The engine according to claim 1, wherein said cam has a profile formed in such a way as to slow down the displacement of the intake valves controlled by the cam, in the final stage of their closing stroke.

9. The engine according to claim 1, wherein said engine is provided with intake valve variable actuating means, comprising: an solenoid valve per engine cylinder, which controls the communication of a hydraulic actuating system of the intake valves with a low pressure exhaust channel, so that, when the solenoid valve is open, the intake valves of a given cylinder are uncoupled from said cam and are kept closed by said return spring means, electronic control means to control the solenoid valve associated to each engine cylinder, in such a way as to vary the time in the opened condition and/or the lift of the respective intake valves as a function of the engine operating conditions.

10. The engine according to claim 9, wherein said low pressure exhaust channel is in communication with a fluid accumulator.

11. The engine according to claim 9, wherein said low pressure exhaust channel is in communication with the engine lubricating circuit through a check valve which only allows fluid to flow from the engine lubricating circuit towards said low pressure channel.

12. The engine according to claim 9, wherein said low pressure exhaust channel is in communication with a fluid tank upwardly closed by a wall provided with an air vent opening.

13. The engine according to claim 9, wherein said low pressure exhaust channel is connected to the engine lubricating circuit through a siphon device, comprising a container upperly vented to the atmosphere which has an upper part of the container connected to a lubricating circuit and a lower part of the container connected to said exhaust channel.

* * * * *